United States Patent [19]

Muska

[11] 3,933,001

[45] Jan. 20, 1976

[54] DISTRIBUTING A CARBON DIOXIDE SLURRY

[75] Inventor: Allen V. Muska, Berkeley Heights, N.J.

[73] Assignee: Airco, Inc., Montvale, N.J.

[22] Filed: Apr. 23, 1974

[21] Appl. No.: 463,226

[52] U.S. Cl. ..... 62/47; 62/10

[51] Int. Cl.[2] ..... F25J 1/00

[58] Field of Search ..... 62/8, 12, 10, 13, 35, 45–47, 62/66, 165

[56] References Cited

UNITED STATES PATENTS 3,810,365 5/1974 Hampton ..... 62/165

*Primary Examiner*—Norman Yudkoff
*Assistant Examiner*—Frank Sever
*Attorney, Agent, or Firm*—David L. Rae; H. Hume Mathews; Edmund W. Bopp

[57] ABSTRACT

Methods and apparatus for producing and distributing a slurry of finely divided unagglomerated carbon dioxide particles suspended in liquid carbon dioxide include the production of liquid $CO_2$ from carbon dioxide gas. A $CO_2$ slurry is then formed in a reactor by introducing liquid $CO_2$ therein, agitating the same and concurrently controlling the rate of evaporation. The slurry so formed is pumped to a storage vessel wherein the solids concentration of the slurry may be increased. Slurry is subsequently pumped into a trailer for transport to a customer location with excess $CO_2$ liquid within the trailer being decanted and returned to the storage vessel thereby increasing the solids content of transported slurry to 60–80 percent. During transport, the slurry is permitted to settle within the trailer and upon reaching a customer location, the settled slurry is reslurried prior to discharge from the trailer. Slurry is then discharged and introduced into a suitable customer storage vessel wherein the slurry is maintained as an unagglomerated suspension of finely divided solid $CO_2$ particles in liquid carbon dioxide until utilization thereof is desired, at which point slurry is fed to suitable utilization devices.

1 Claim, 3 Drawing Figures

DISTRIBUTING A CARBON DIOXIDE SLURRY

BACKGROUND OF THE INVENTION

This invention relates to methods and apparatus for the production and distribution of a carbon dioxide slurry, and more particularly to methods and apparatus for transporting such a slurry from a production site to a remote customer station for utilization thereat.

In numerous applications, such as for example food freezing processes, it has been found economical to obtain necessary refrigeration from consumable refrigerant products. For example, liquid carbon dioxide which is commonly supplied at 300 p.s.i.g. and 0°F, is in widespread use as such a refrigerant product. Solid carbon dioxide, commonly known as "dry ice" is also used as a refrigerant in certain applications, Although solid carbon dioxide yields, 1.9 times as much refrigerant capability (B.T.U.) per pound of material as compared with liquid carbon dioxide, use of solid $CO_2$ does not find widespread acceptance due to the difficulty in handling this product. As liquid carbon dioxide is more susceptible to simpler handling and transport techniques, inasmuch as liquid $CO_2$ may be readily pumped, utilization of liquid $CO_2$ for refrigeration purposes is preferred over use of this material in solid form for large scale or tonnage applications.

It has been found that by maintaining carbon dioxide at substantially triple point conditions, i.e. 60 p.s.i.g., −70°F, a slurry comprised of finely divided, unagglomerated particles of solid $CO_2$ suspended in liquid carbon dioxide may be produced. It has also been found that such a carbon dioxide slurry contains greater refrigeration capacities than an equivalent weight of liquid carbon dioxide. In addition, it has been observed that the greater the solids content of a $CO_2$ slurry, the greater is the refrigeration capacity of each unit of slurry product. However, as the solids concentration of a slurry increases, the difficulties of pumping the slurry and the likelihood of clogging slurry conduits increase accordingly. Nonetheless, the economies of utilizing carbon dioxide slurry as a refrigerant product may be exploited upon the careful handling thereof.

While a carbon dioxide slurry may be produced in a reaction vessel, as will be described in detail hereafter, certain difficulties have been encountered in the subsequent transportation and distribution of such a slurry. It has been found that once solid carbon dioxide particles, which preferably exhibit a maximum cross-sectional dimension of 4 microns to 2 millimeters, are suspended in liquid carbon dioxide in slurry form, particle size cannot be reduced during subsequent handling operations. Therefore, unless particles of solid $CO_2$ are formed with approximately the foregoing dimensions, handling apparatus, such as conduits and pumps, are readily plugged or clogged. In addition, it has been observed that upon standing, solid carbon dioxide particles tend to settle to the bottom of a container vessel and although such particles do not agglomerate, settled particles must be reslurried before slurry product can be discharged from the vessel. Accordingly, the transport apparatus, such as a slurry trailer, must either provide an agitating device or further pump means to reslurry settled solid particles prior to discharge of the slurry. Retention of the slurry in a suitable storage vessel at a remote or customer location also requires that some means, i.e., an agitator device, pump, etc., be provided for maintaining the slurry in a pumpable condition with solid particles suspended in liquid carbon dioxide. Furthermore, in order to preserve the economical advantages of a carbon dioxide slurry, the capital and operating costs incurred in providing apparatus for maintaining a suspension of solid $CO_2$ particles in liquid carbon dioxide must be minimized.

OBJECTS OF THE INVENTION

Accordingly, it is an object of the present invention to provide methods and apparatus for efficiently producing and distributing a carbon dioxide slurry.

It is another object of the present invention to provide methods and apparatus for transporting a carbon dioxide slurry in a transportable container with the slurry therein exhibiting a relatively high solids concentration.

It is a further object of the present invention to provide methods and apparatus for transporting a carbon dioxide slurry wherein settled solid particles of $CO_2$ are reslurried prior to discharge from the transportable container.

It is yet another object of the present invention to provide methods and apparatus for maintaining a carbon dioxide slurry in a pumpable form at a remote storage location.

It is still a further object of the present invention to provide methods and apparatus for distributing a pumpable carbon dioxide slurry having a solids concentration of carbon dioxide particles within predetermined values.

It is yet a further object to provide methods and apparatus to transport a pumpable carbon dioxide slurry under while maximizing the solids concentration thereof and hence minimizing the distribution cost per unit weight of such slurry product.

Other objects of the present invention will become apparent from the detailed description of an exemplary embodiment thereof which follows and the novel features of the present invention will be particularly pointed out in conjunction with the claims appended hereto.

SUMMARY

In accordance with one embodiment of the present invention, an exemplary method for producing and delivering a carbon dioxide slurry comprises the steps of producing a slurry consisting of finely divided solid particles of carbon dioxide dispersed in unagglomerated form in liquid $CO_2$, introducing said slurry into a transport vehicle, transporting said introduced slurry to a customer station, reslurrying solid particles of carbon dioxide which have settled from said slurry during transport thereof and discharging said reslurried carbon dioxide slurry from said transport vehicle at said customer station. The customer station is preferably provided with a receiving vessel adapted to receive discharged slurry and maintain solid carbon dioxide particles suspended in the received slurry in substantially unagglomerated form.

BRIEF DESCRIPTION OF THE DRAWINGS

The invention will be more clearly understood by reference to the following detailed description of an exemplary embodiment thereof in conjunction with the following drawing in which.

DESCRIPTION OF PREFERRED EMBODIMENT

Figure 1:
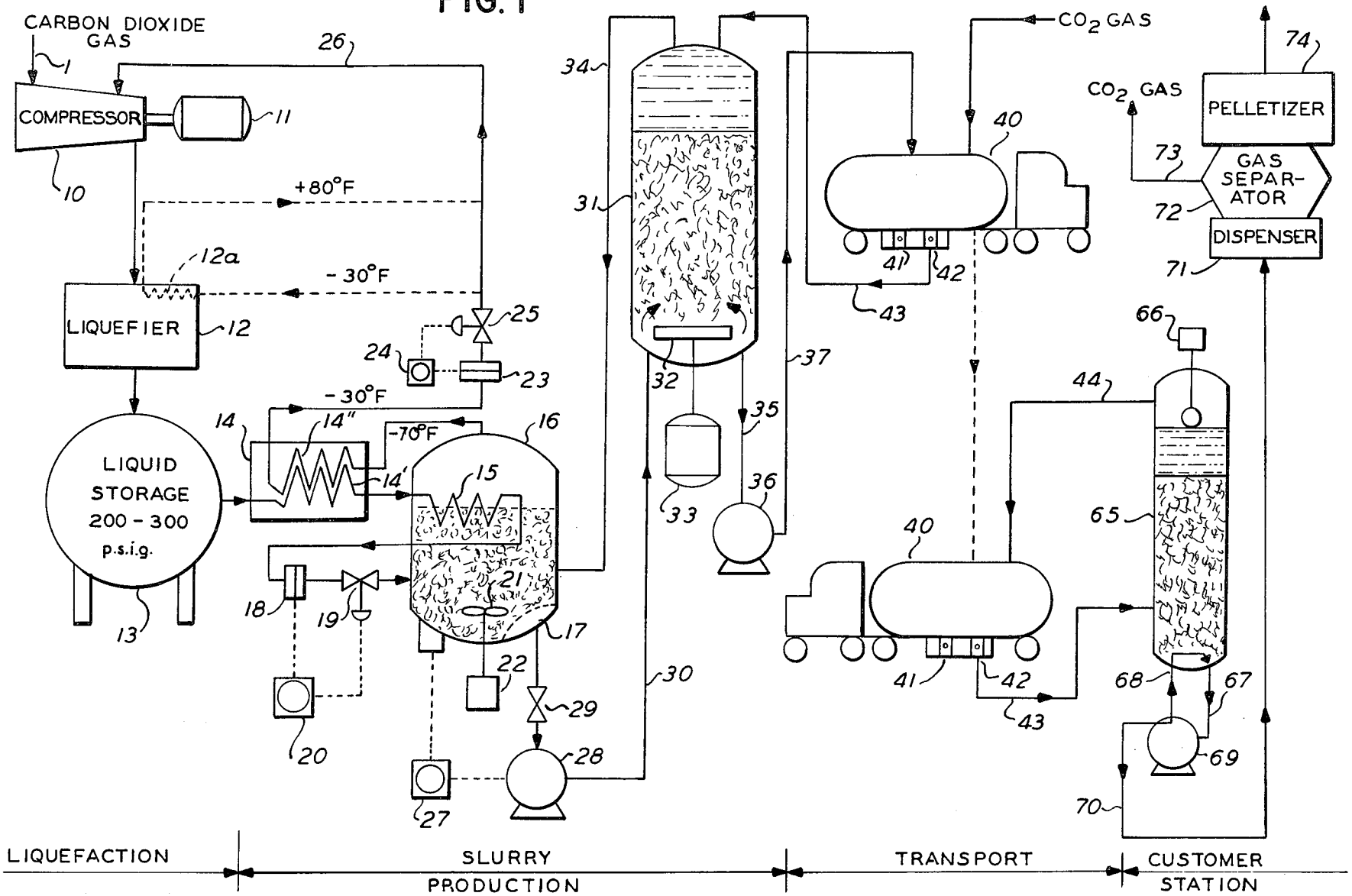
FIG. 1 is a schematic illustration of apparatus for producing and distributing a carbon dioxide slurry of finely divided particles of solid carbon dioxide suspended in unagglomerated form in liquid $CO_2$ in accordance with the teachings of the present invention.

Referring now to the FIG. 1 of the drawing, there is illustrated an exemplary embodiment of a system for producing and distributing a carbon dioxide slurry comprising liquefaction, production, transport and customer stages. The liquefaction and slurry production stages illustrated in the drawing are described in detail in U.S. Pat. application Ser. No. 258,962 which is assigned to the assignee of the present invention. However, a preferred form of such liquefaction and slurry production stages will be briefly described hereafter.

The liquefaction stage of the system according to the invention is comprised of a compressor 10, motor 11, liquefier 12 and liquid storage means 13. Compressor 10 may take the form of a conventional device capable of receiving gas, such as carbon dioxide gas, and increase the pressure thereof to a predetermined value at the outlet of the device. An electrical motor 11 which may comprise a conventional prime mover is arranged in known fashion to drive compressor 10. The pressurized carbon dioxide gas is supplied from compressor 10 to liquefier 12 which may take the form of known apparatus capable of receiving material in a gas or vapor phase at an outlet thereof and supplying such material to an outlet in a liquid phase. Accordingly, liquefied carbon dioxide is supplied to liquid storage means 13 and, in known manner, is maintained therein at for example a temperature of −20° to 0°F at the appropriate equilibrium pressure.

The exemplary embodiment of the slurry production stage illustrated in the drawing includes an economizer 14, a reaction vessel 16 provided with heating coil 15, agitator means 21 and a storage vessel 31 provided with agitator means 32 together with suitable conduits and flow control means. Liquid storage means 13 is connected to reactor 16 although, if desired, an adsorber (not shown), which may take the form of conventional apparatus for reducing the moisture content of a liquid supplied thereto, is interconnected therebetween. Preferably, such an adsorber is effective to supply liquid carbon dioxide with a moisture content of approximately 2 ppm. at the outlet thereof, although should a particular utilization device to be described hereafter require a significant moisture content in the carbon dioxide supplied thereto, such an adsorber will not be utilized. A reaction vessel 16, which may comprise any known vessel capable of maintaining carbon dioxide at substantially triple point conditions, namely −70°F and 60 p.s.i.g., is provided. Economizer 14, which may comprise a conventional two pass heat exchange device, is connected to receive at the inlet of pass 14' liquid carbon dioxide stored in vessel 13. The second pass 14'' of economizer 14 is connected to receive carbon dioxide vapor vented from reactor 16 and to supply such vapor to sensing means 23, which will be described hereafter, for eventual return to compressor 10. The outlet of pass 14' of economizer 14 is connected to a conventional heating coil 15 which is provided on the outer wall of reactor 16 and is disposed at a vertical level substantially equal to the slurry-vapor interface in the reactor. Accordingly, liquid carbon dioxide suppled to heating coil 15 is reduced in temperture from approximately −40°F to approximately −45°F with the heat produced being dissipated at the foregoing interface in order to prevent formation of solid carbon dioxide on the walls within reactor 16. Liquid carbon dioxide is then supplied to a flow control means comprised of a sensing device 18, an adjustable valve 19 and a flow controller 20 all of which elements are conventional and operate in known manner to maintain a constant flow of liquid carbon dioxide to an inlet of reactor 16. As aforesaid, reactor 16 is provided with an agitator means 21, which may take the form of a rotatable impeller blade member suitably mounted on a shaft preferably entering the bottom of reactor 16 and driven by a motor 22. Agitator means 21 is positioned at an appropriate level within reactor 16 and is operated at a speed sufficient to generate a slurry of finely divided, unagglomerated particles of solid $CO_2$ suspended within reactor 16 is described in detail in the above-identified application. It is preferred to utilize a bottom entering agitator means 21 in order to avoid ice formation on the agitator shaft which tends to develop upon utilization of an agitator means extending through the vapor space within the reactor.

The rate at which solid carbon dioxide particles are formed in the liquid carbon dioxide, and hence the rate at which slurry is produced, is controlled by the rate of evaporation of the liquid carbon dioxide within reactor 16. The latter rate is controlled by adjustably determining the rate at which carbon dioxide vapor is vented from reactor 16. In order to effect such a controlled flow of vented vapor, an arrangement, comprised of sensing means 23, flow controller 24 and adjustable valve 25 is provided. By setting controller 24 to a desired value, the flow of carbon dioxide vapor returned to compressor 10 by way of conduit 26 is maintained at a constant rate. In addition, the carbon dioxide vapor vented from reactor 16 is supplied to pass 14'' of economizer 14 to effect the cooling of liquid carbon dioxide from, for example, −20°F to −40°F and such vapor may subsequently be supplied to a cooling coil **12*a* of liquefier 12 in order to assist in the cooling of carbon dioxide vapor supplied thereto. Thus, for example, $CO_2$ vapor at −70°F (the triple point temperature) is supplied to pass 14'' with such vapor exiting therefrom at, for example, a temperature of −30°F passed to coil 12*a* and eventually returned to compressor 10** at approximately 80°F.

The slurry of finely divided unagglomerated solid carbon dioxide particles suspended in carbon dioxide liquid is preferably removed from reactor 16 through a screen 17 which inhibits the transfer of an occasional large particle of solid carbon dioxide by means of pump 28. A conventional level controller 27 is appropriately coupled to reactor 16 and pump 28 and, in known manner, is effective to regulate the feed of slurry by pump 28 in accordance with the amount of slurry produced in reactor 16. Thus, should the amount of slurry formed within reactor 16 increase, the speed of pump 28 is likewise increased to remove slurry at a greater rate and thereby maintain a predetermined and substantially constant level of slurry within the reactor. Pump 28 may take the form of a conventional positive displacement pump and, for example, may comprise a known gear pump capable of being driven to pump carbon dioxide slurry at sufficient velocities through slurry line 30 to avoid plugging therein. A shut-off valve 29 which typically may comprise a fully-ported ball valve, is appropriately disposed in the conduit interconnected between reactor 16 and the suction inlet of pump 28. It has been found that by utilizing a value such as a fully-ported ball valve, abrupt or precipitous alterations in the internal valve configuration are avoided thereby providing a flow path of substantially constant diameter through valve 29 and reducing the likelihood of the formation of agglomerated carbon dioxide deposits which encourage valve plugging.

The operation of the exemplary slurry production stage of the apparatus according to the present invention will now be briefly described. Reactor 16 is initially pressurized by an inert material such as nitrogen gas to a pressure of approximately 60 p.s.i.g. and liquid carbon dioxide is introduced into reactor 16. Upon introduction of a sufficient amount of such liquid, agitator means 21 is activated and carbon dioxide vapor is vented at a controlled, predetermined rate. The formation of finely divided unagglomerated particles of solid carbon dioxide at the liquid carbon dioxide surface is thereby effected with the venting of vapor and operation of agitator means 21 continued until a predetermined solids concentration, such as, for example, 30 percent, is present within reactor 16. In the course of continuously operating reactor 16, vapor is vented at a controlled rate as aforedescribed and slurry is removed therefrom at a predetermined rate through the action of pump 28. In order to substantially avoid ice formation on the interior walls of reactor 16 in the vapor space therein, all liquid carbon dioxide introduced into reactor 16 is preferably introduced below the slurry-vapor interface. It has been found that upon discontinuance of reactor operation, solid particles of carbon dioxide in the slurry formed therein will settle to the bottom of reactor 16 and a relatively high density slurry fills the inside of screen 17 immediately above the outlet to pump 28. Accordingly, the reactivation of agitator means 21 prior to restarting pump 28 is ineffective to adequately mix or reslurry the high density slurry material that previously settled inside screen 17. Consequently, the latter slurry material, which will exhibit a solids concentration substantially greater than the desired concentration of approximately 30 percent, is passed to the inlet of pump 28 and tends to overload the same. It has been found, however, that by introducing liquid carbon dioxide into the inside portion of screen 17 within reactor 16, a "back flushing" effect may be achieved. Thus, the relatively high density slurry which has previously settled inside screen 17 may be thinned out and in this manner overloading of pump 28 upon the subsequent restarting thereof is avoided.

As previously described, economizer 14 is effective to reduce the temperature of liquid carbon dioxide feed supplied to reactor 16 from a typical storage temperature of −20°F to approximately −40°F. As it has been found that only a slight degree of heating is required to avoid formation of solid carbon dioxide on the interior walls of reactor 16 at approximately the slurry-vapor interface therein, heating coil 15 is designed such that the temperature of liquid carbon dioxide flowing therethrough is reduced by approximately 5°F and hence the temperature of liquid introduced into vessel 16 is reduced to approximately −45°F. In passing liquid carbon dioxide through valve 19 prior to the introduction of liquid into reactor 16, the pressure of liquid carbon dioxide is reduced from approximately 200 p.s.i.g. to the reactor pressure of roughly 60 p.s.i.g. Such a decrease in pressure results in an enthalpy change of the liquid carbon dioxide and generates, by flashing, a quantity of carbon dioxide gas. However, the quantity of such flashed gas produced upon the aforementioned decrease in pressure, is minimized by supplying carbon dioxide liquid to valve 19 at the approximate temperature of −45°F as compared with a temperature of −20°F to 0°F or the like. Minimization of the carbon dioxide gas flashed upon passage of liquid through valve 19 is effective to reduce the loss of liquid. Stated conversely, in the absence of economizer 14, and thus upon the passage of liquid carbon dioxide through valve 19 at a temperature significantly above −45°F or so, the resulting enthalpy change is effective to generate by flashing substantially greater quantities of carbon dioxide gas than are generated upon passage of liquid carbon dioxide through valve 19 at approximately −45°F. Thus, in the absence of economizer 14, substantially greater losses of liquid carbon dioxide are incurred upon the passage thereof through valve 19 resulting in a reduced liquid carbon dioxide feed. Therefore, in this latter instance, a greater liquid feed is necessary in order to form a predetermined amount of carbon dioxide slurry in reactor 16 and the concomitant carbon dioxide feed costs are increased accordingly. However, as the vapor vented from reactor 16 (at −70°F) is supplied to pass 14″ of economizer 14, no externally generated refrigeration is required in order to reduce the temperature of liquid carbon dioxide in pass 14′. Thus, by recapturing the refrigeration content of vented vapor, economizer 14 will be efficiently operated with the aforedescribed enhancement in the utilization efficiency of a liquid carbon dioxide feed.

The slurry storage section of the exemplary production stage according to the present invention is generally comprised of a storage vessel 31, agitator means 32, motor 33, and pump 36 together with suitable conduits. Storage vessel 31 may comprise any suitable container for maintaining carbon dioxide at approximately triple point conditions and preferably is of sufficient capactiy to maintain, for example, up to 100 tons of slurry therein. Preferably, storage vessel 31 is connected by way of conduit 30 to the outlet of pump 28 with a conventional shut-off valve (not shown) being suitably disposed in conduit 30. Agitator means 32 may take the form of a substantially rigid blade member or impeller mounted for rotation within vessel 31 on a shaft driven in rotation by a conventional electrical motor 33. The slurry fed through line 30 to storage vessel 31 is thus maintained as a solid-liquid slurry within vessel 31 although it is preferable to control agitator means 32 such that the solids concentration of the contained slurry is increased. This is accomplished by effecting relatively low rates of agitation as, for example, compared with the rate at which agitator 21 is driven thereby permitting solids in the slurry to settle toward the lower reaches of vessel 31 with the liquid remaining in the upper portion thereof being withdrawn therefrom and returned to reactor 16 through conduit 34. Thus, by effecting a relatively slow agitation of the slurry within vessel 31, a concentrated slurry, for example, up to 60 percent to 80 percent solids concentration, can be easily produced and maintained therein. It will be appreciated that by concentrating the slurry as aforesaid in storage vessel 31, as opposed to concentrating a slurry in the reactor 16, overall capital costs can be reduced and a reactor 16 of smaller capacity, than would ordinarily be necessary for production of a concentrated slurry, may be utilized. Thus, vessel 31 serves as a means of both storing and concentrating the slurry supplied thereto through conduit 30.

It is realized that although a rotatable impeller blade is described as comprising agitator means 32 appropriately mounted within storage vessel 31, other types of agitators may be employed. The slurry formed therein may be maintained by recycling slurry by introducing a jet of recycled slurry to provide the agitation required to inhibit settling of solid carbon dioxide from the slurry as will be described hereafter. The concentrated slurry may be removed from storage vessel 31 through conduit 35 by means of pump 36, which in turn is effective to supply slurry through conduit 37 to the transport stage of the exemplary slurry production and distribution system according to the present invention. It will be appreciated that pump 36 is of adequate capacity to sustain a slurry flow in conduit 37 at velocities sufficient to inhibit settling of solids therein and consequently plugging or jamming of conduit 37 is avoided. In addition, suitable shut-off valves (not shown) which may be of a type similar to valve 29 described hereinbefore may be appropriately connected in conduits 35 and 37 to permit selective control of the slurry flow to the suction (inlet) and pressure (outlet) lines of pump 36.

In order to transport slurry from a production site to a remote customer station, a slurry trailer 40 is utilized. The trailer which is illustrated in greater detail in FIG. 2 and which will be described hereafter is preferably of sufficient capacity for transporting up to 20–25 tons of carbon dioxide slurry and is provided with the appropriate temperature and pressure controls for maintaining slurry at approximately −70°F and at approximately 60 to 100 p.s.i.g. Accordingly, trailer 40 must be provided with suitable insulation for maintaining the aforementioned temperature and must be of sufficient strength to withstand pressures of approximately 60 to 100 p.s.i.g. together with appropriately disposed pressure sensitive switches and safety valves (not shown) operated thereby in response to the detection of excessive pressures within trailer 40 or in conduits utilized therewith. It will be appreciated, however, that as liquid carbon dioxide is normally transported in trailers under pressures of approximately 300 p.s.i.g. slurry trailer 40 is not required to withstand such higher pressures which in turn enables substantial reduction in the amount and weight of materials necessary to construct trailer 40 within acceptable safety tolerances. The foregoing reductions consequently aid in diminishing costs of distributing carbon dioxide slurry in comparison with distribution of liquid carbon dioxide.

Slurry trailer 40 is provided with a reslurry pump 41 and a slurry discharge pump 42. The former pump may, for example, take the form of a conventional liquid $CO_2$ pump manufactured by Smith Precision, Incorporated and which is effective to pump a carbon dioxide slurry at a flow rate of approximately 200 g.p.m. under a pressure head of 50 p.s.i.g. Discharge pump 42 may take the form of a suitable pump device such as that manufactured by Smith Precision and which is effective to pump carbon dioxide slurry at a flow rate of approximately 150 g.p.m. under a pressure head of 100 p.s.i.g. As will be described in greater detail hereafter, a conduit 43 is connected to the outlet of dishcarge pump 42 to enable either the decanting of liquid carbon dioxide and the return thereof to vessel 31 during the loading of trailer 40 or, the removal of carbon dioxide slurry and the transfer thereof to customer storage vessel 65 during the unloading of trailer 40. It will be understood, however, that a single pump connected to appropriate valves and conduits may be utilized in lieu of pumps 41 and 42 to perform the functions necessary to the loading and unloading of trailer 40 as will be described in detail hereinafter.

Figure 2:
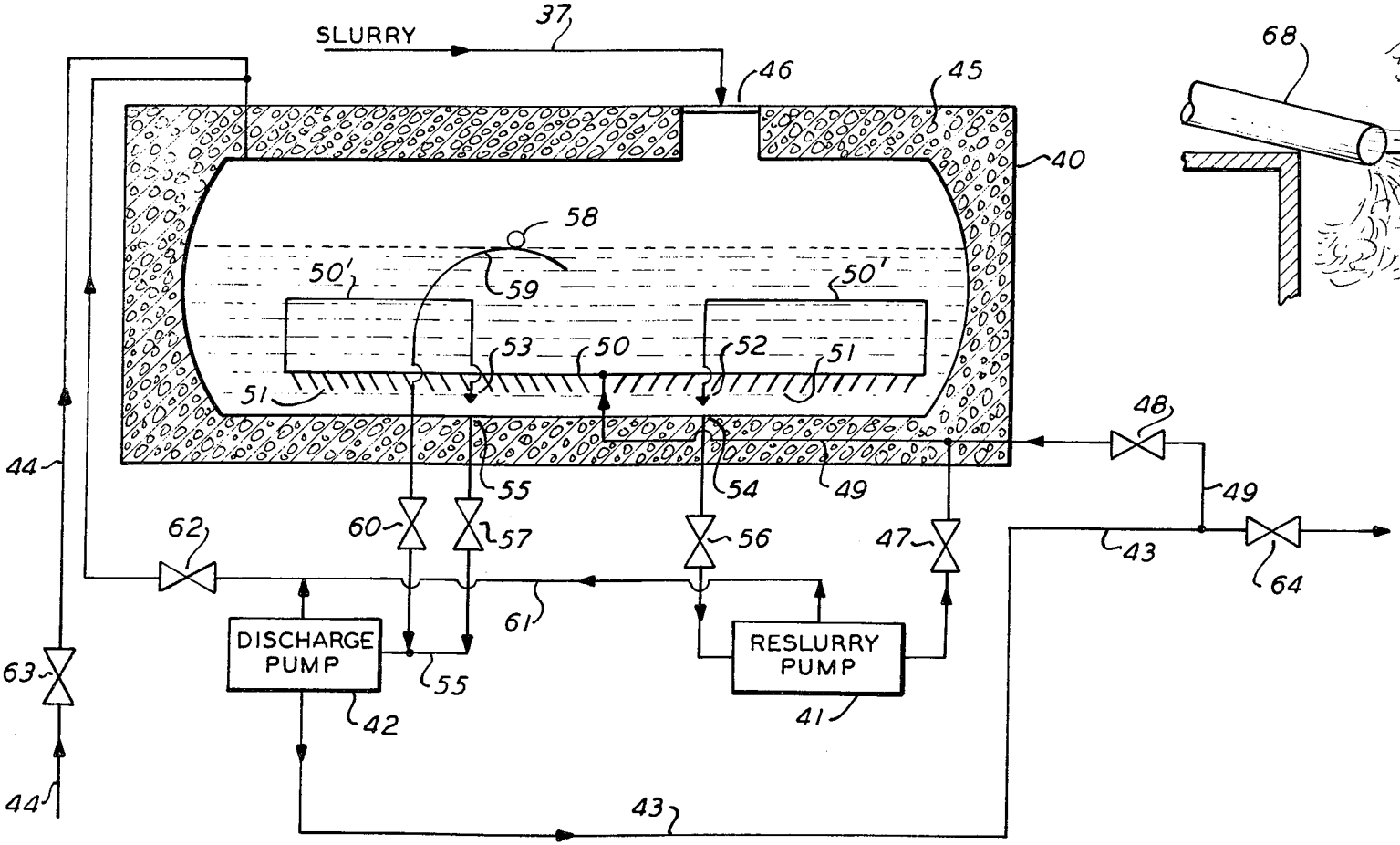
FIG. 2 is a diagrammatic view of a portion of a trailer suitable for transporting a carbon dioxide slurry.

Turning now to FIG. 2, illustrated therein is an exemplary embodiment of a slurry trailer 40 together with reslurry and discharge pumps 41 and 42, respectively, and additional conduits and valves necessary to facilitate the loading and unloading of a carbon dioxide slurry into and from trailer 40. Before describing in detail the foregoing apparatus and the operation thereof, it will be understood that a carbon dioxide slurry comprised of solid carbon dioxide uniformly suspended in liquid carbon dioxide as a pumpable and readily flowable substance, is introduced into slurry trailer 40. During transport of this slurry from a production site (e.g. from reactor 16 and storage vessel 31) to a remote customer utilization location the finely divided particles of solid carbon dioxide will settle in unagglomerated form at the bottom or lower reaches of trailer 40 with a body of liquid carbon dioxide existing generally above the settled particles. In addition, although trailer 40 is satisfactorily insulated, a certain degree of heat leakage will necessarily occur during transport, which leakage is reflected as a transformation of a portion of the solid carbon dioxide into liquid. Thus, upon reaching a remote customer location, the aforementioned solid carbon dioxide must be reslurried such that a readily flowable and pumpable slurry material may be delivered for ultimate customer use. While certain forms of agitating devices, such as one or more impeller blades as previously described with reference to reactor 16 and vessel 31, or a screw type conveyor, may be utilized to continually maintain solid carbon dioxide in suspension during the transport thereof, it has been found most economical in terms of both capital equipment and operating costs to permit the solid carbon dioxide particles of the slurry introduced into trailer 40 to settle at the bottom or lower reaches thereof. As a consequence of the settled solid material exhibiting a substantially unagglomerated form, the finely divided solid particles may be readily reslurried prior to the discharge of slurry material from trailer 40 and for this reason, the apparatus now to be described is economically preferable to apparatus for effecting the aforementioned continuous agitation of a transported slurry. However, in the event that such agitating devices as previously mentioned are sufficiently economical in terms of both initial and operating costs than the apparatus for reslurrying a carbon dioxide slurry as will be described, utilization of such agitating devices to maintain a solid/liquid slurry during transport thereof is within the purview of the teachings of the present invention.

Slurry trailer 40 is appropriately provided with a suitable insulating material 45, which may comprise polyurethane foam, and in the top or upper portion thereof with a suitable inlet 46 which is adapted to receive carbon dioxide slurry supplied thereto through, for example, conduit 37. Inlet 46 may be configurated as a "manway" having a diameter of approximately 16 inches through which carbon slurry is introduced. Alternatively, inlet 46 may be configurated as a conduit extending from the top of trailer 40 to the lower reaches thereof, or inlet 46 may be provided as a simple inlet in the lower reaches of trailer 40 to thereby enable a submerged slurry feed. In addition, sight windows (not shown) may be provided to enable the visual inspection of the interior of trailer 40. It will be understood that carbon dioxide slurry to be transported may be supplied from a storage vessel 31 or, such slurry may be supplied to trailer 40 directly from reactor 16 by means of conduit 30, althrough in relatively large scale commercial operations the utilization of storage vessel 31 is preferred for reasons indicated heretofore.

A conduit 44 is connected through a conventional shut-off valve 63 to the upper reaches of trailer 40 and, as will be described hereinafter, is effective to convey a pressurizing gas such as carbon dioxide vapor into trailer 40. In addition to the previously described pumps 41 and 42, trailer 40 is provided with a reslurry header 50 and a plurality of shut-off valves and conduits as will now be described. The suction line or inlet 54 of reslurry pump 41 is connected in communication with the lower reaches of trailer 40 through a shut-off valve 56 which may comprise a conventional fully-ported ball valve. The outlet of reslurry pump 41 is connected to conduit 49 through a shut-off valve 47 which may conveniently take the form of a conventional device similar to valve 56. Similarly, the inlet or suction line 55 of discharge pump 42 is disposed in communication with the lower reaches of trailer 40 through a further conventional shut-off valve 57. Additionally, the inlet of pump 42 is connected through a further conventional valve 60 to a decanting conduit 59. A decanting float 58 is appropriately arranged to maintain the inlet of conduit 59 (the extremity thereof remote from valve 60) slightly beneath the surface of liquid carbon dioxide formed within slurry trailer 40. It will be appreciated that upon reslurry of the solid and liquid carbon dioxide prior to discharge of slurry from trailer 40, decanting float 58 will merely float on the slurry surface. The outlet of discharge pump 42 is connected to a conduit 43 which in turn may be selectively placed in communication by means of a conventional shut-off valve 64, with storage vessel 31 or customer station 65 during the loading and unloading, respectively, of slurry trailer 40 as will be subsequently described in greater detail. In addition, both reslurry pump 41 and discharge pump 42 are connected to a conduit 61 which, through a conventional shut-off valve 62, may be selectively placed in communication with the upper reaches of trailer 40. It will be appreciated that during the priming of pumps 41 and 42, the vapor therein must be initially removed to enable pump operation and such vapor, in this instance in the form of carbon dioxide vapor, is merely recovered from such pumps and is returned to the upper reaches of trailer 40.

Reslurry header 50 may take the form of a conduit disposed substantially parallel to the longitudinal axis of trailer 40 and is preferably adapted to receive carbon dioxide slurry, or liquid carbon dioxide (as will be described hereinafter), supplied thereto through conduit 49. Reslurry header 50 is provided with a plurality (such as for example 30) of nozzles 51 disposed to extend therefrom in a generally downwardly inclined configuration as illustrated in exemplary fashion in FIG. 2. Conduit 49 is typically connected to a relatively central position along reslurry header 50 and rather than terminating the extent of header 50 at the nozzles most remote from the header connection to conduit 49, header 50 is configured with a pair of reslurry jets 52 and 53 disposed at extremities thereof as illustrated in FIG. 2. Reslurry jets 52 and 53 are preferably disposed in juxtaposition with respect to inlets 54 and 55 of reslurry pump 41 and discharge pump 42, respectively. It will be appreciated that as a result of the settling of solid carbon dioxide particles from the slurry during transport, header 50, which is preferably disposed in the lower reaches of trailer 40, will be substantially totally surrounded by such solid materials. It will be seen that by extending header 50 from the leftmost and rightmost of nozzles 51 and thereby providing reslurry jets 52 and 53 as aforedescribed, recycled slurry emitted from nozzles 51 will be emitted from each of such nozzles at an adequate velocity to effect the reslurrying of solid carbon dioxide particles. Furthermore, in order to assure that liquid carbon dioxide, as will be described, is emitted from jets 52 and 53 at acceptable velocities the extending portions 50' of reslurry header 50 may take the form of a conduit of smaller diameter or cross section than the diameter of header 50 coextensive with the aforementioned arrangement of nozzle 51.

The slurry loading and unloading operations will now be described in connection with the exemplary carbon dioxide slurry trailer apparatus illustrated in FIG. 2. The loading of slurry into trailer 40 is initiated by pressurizing the trailer to approximately 60 p.s.i.g. and for this purpose, the carbon dioxide vapor maintained in reactor 16 (FIG. 1) may be utilized although any suitable source of carbon dioxide at such a pressure may be employed for this purpose. Carbon dioxide slurry is then supplied to trailer 40 through conduit 37 (or from reactor 16 via conduit 31) and is introduced through an appropriate connection in inlet 46. Upon introduction of slurry into trailer 40, particles of solid carbon dioxide settle toward the bottom thereof thereby resulting in a body of liquid carbon dioxide forming above such solid particles. In addition, as the temperature within the slurry trailer 40 is commonly above the triple point temperature of −70°F due to heat leakage, the slurry is effectively heated thus causing a portion of the solid particles to melt and increasing the total content of liquid carbon dioxide within trailer 40. However, notwithstanding such a melting of solid carbon dioxide, the solids concentration of the slurry eventually discharged from trailer 40 may be increased by decanting a portion of the liquid carbon dioxide formed as previously described such that the overall solids contents (% solids) of the carbon dioxide material within trailer 40 may be increased. In order to decant such liquid carbon dioxide, valves 60 and 62 are opened. Upon priming of pump 42 and the removal of vapor therefrom through valve 62, this valve is closed, the discharge pump 42 is energized, and liquid carbon dioxide is withdrawn from trailer 40 through conduit 59 and is transferred by means of pump 42 to conduit 43 and such liquid is preferably returned through valve 64 to storage vessel 31 as illustrated in FIG. 1. The decanting of liquid carbon dioxide is continued until a predetermined amount of liquid is removed from trailer 40 and at such time discharge pump 42 is disabled and valve 60 is closed. The introduction of slurry into trailer 40, however, may continue until a desired quantity of slurry is provided therein. At this point, valve 63 is closed whereupon the pressurization of trailer 40 is terminated and the trailer may now be transported to a remote customer station.

Upon arrival of trailer 40 at a remote customer station, slurry is discharged in the manner now to be described. Initially, trailer 40 is pressurized preferably to a pressure of approximately 67–75 p.s.i.g. by the introduction of a pressurizing gas such as carbon dioxide vapor through conduit 44 and valve 63. Conveniently, the carbon dioxide vapor which forms in the upper reaches of a typical customer storage vessel 65, which will be described in greater detail hereafter, may be utilized as the pressurizing gas. The actual discharge of a carbon dioxide slurry from trailer 40 may be considered to comprise essentially three stages: (1) preparation for the operation of reslurry pump 41; (2) reslurrying the contents of trailer 40; and (3) discharge of the reslurried solid-liquid carbon dioxide slurry through conduit 43. As previously indicated, during transport of the carbon dioxide slurry, the solid particles thereof settle toward the bottom of trailer 40 and in order to discharge a slurry, the solid particles must be reslurried. However, it has been found that by merely energizing reslurry pump 41, the solids residing in and about the entrance of the suction line thereof, tend to overload this pump. In order to avoid this deleterious result and yet enable a reslurrying of the contents of trialer 40, valves 60 and 62 are opened. Upon sufficient priming of pump 42, valve 62 is closed, valve 48 is opened and pump 42 is energized. As valve 64 is closed, liquid carbon dioxide "decanted" through conduit 59 is supplied through valve 48 to conduit 49 and is subsequently passed to header 50. Liquid carbon dioxide is emitted from nozzles 51 of header 50 thereby generating a turbulent condition in the lower reaches of trailer 40 and tending to agitate or reslurry the solid particles thereat, although more importantly, liquid carbon dioxide is passed through extensions 50' of header 50 and is issued from jets 52 and 53. As jets 52 and 53 are juxtaposed with respect to the entrance of suction lines 54 and 55, respectively, the aforedescribed emission of liquid carbon dioxide is effective to cause a relatively high degree of fluidization at the entrance of and in suction lines 54 and 55 thereby effecting a reduction in the solids concentration thereat such that reslurry pump 41 may be operated without jamming the same and overloading the motor thereof. Thus, after a brief period (e.g. 1 min.) the second phase of the slurry discharge operation may be effected by the opening of valves 56 and 47 and the energization of reslurry pump 41. During this period discharge pump 42 continues to operate and the contents of trailer 40 are effectively reslurried as a result of the fluidization or agitation of solids residing in the lower reaches of trailer 40. This fluidization is achieved effectively by the emission of slurry from nozzles 51 appropriately disposed on header 50 and upon continuance of this phase of the discharge operation for a predetermined duration (typically 2 min.), the contents of trailer 40 will be sufficiently reslurried.

Upon adequately reslurrying the contents of trailer 40 as described heretofore, the third and final stage of the slurry discharge operation may be effected. Both pumps 41 and 42 are operating and valves 57 and 64 are opened thus passing slurry to customer station 65. Valve 60 is then slowly closed and when the loading of pump 41 drops below the design load, valve 48 is slowly closed thereby passing the total slurry flow through conduit 43 to a customer station 65. It will be appreciated that as a result of previously causing the emission of liquid carbon dioxide from jets 52 and 53 of slurry header 50 and by reslurrying the contents of trailer 40 by the emission of slurry from nozzles 51, the material withdrawn from trailer 40 into suction line 55 is not of a sufficiently high solids concentration as to result in the jamming or plugging of discharge pump 42 or overloading the motor thereof. The slurry discharge operation is continued until the contents of the trailer 40 have been substantially completely withdrawn and transferred to a customer station. Valve 63 is then closed thereby terminating the pressurization of trailer 40 and upon disconnection of conduit 44 from an appropriate gas source as previously mentioned, trailer 40 may be returned to a production site to enable a further slurry laoding operation.

Returning now to FIG. 1, the customer station stage of the slurry production and distribution system according to the present invention preferably comprises a slurry storage vessel 65, pump 69, utilization devices 71, 72 and 74 and appropriate conduits. Slurry storage vessel 65 may take the form of a known pressure vessel adapted to receive a slurry product from, for example, trailer 40 through discharge pump 42 and conduit 43, and is typically designed to retain up to approximately 100 tons of carbon dioxide slurry. Preferably, slurry product is maintained in vessel 65 at a pressure of, for example, 75 p.s.i.g., which pressure is relatively low in comparison to conventional storage pressures of liquid carbon dioxide and thereby enables a significant reduction in the capital costs of such a storage vessel. A liquid level indicator 66 which may take the form of a known device for either continuously displaying the amount of slurry and liquid carbon dioxide product within vessel 65 is suitably mounted thereon. It is to be understood that introduction of slurry into storage vessel 65 by way of discharge pump 42 as aforedescribed is permitted to continue until level indicator 66 reflects the presence of a predetermined amount of slurry within vessel 65.

Subsequent to the loading of slurry product into storage vessel 65, slurry may be withdrawn therefrom at the convenience of the customer or user. However, as previously mentioned, solid carbon dioxide particles suspended in the slurry settle relatively rapidly toward the bottom of any vessel containing such a slurry unless some means are specifically provided for maintaining such solid particles in suspension. A reslurry pump 69, which may take the form of a conventional pump similar to reslurry pump 41, is provided with the inlet thereof communicating through line 67 with the lower reaches of vessel 65. The outlet of pump 69 is connected through a recycle conduit 68 to storage vessel 65, as will be described in greater detail hereafter, and is additionally connected to an outlet conduit 70. Although in the apparatus illustrated in FIG. 1, a recycle pump is illustrated as the means for maintaining a carbon dioxide slurry within vessel 65, other devices such as a rotating impeller blade may be utilized in lieu of recycle pump. Although installation of an agitating device in the form of a rotating impeller blade presently requires a greater capital investment than does the installation of a conventional recycle pump 69, operation of such a pump has the effect of heating the slurry product flowing therethrough and as substantial amounts of this flow, e.g. to approximately 90 percent, are returned to vessel 65, a significant loss of solids is encountered during utilization of recycling pump 69. Accordingly, for any particular customer station, the relative advantages and disadvantages of both the impeller type and recycling pump type of slurry agitation apparatus must be weighed to determine the most economical form of agitation device to be utilized in conjunction with a particular slurry retaining vessel.

Figure 3:
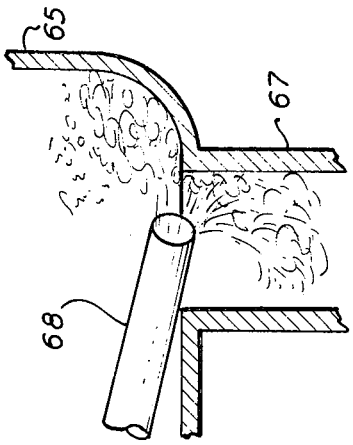
FIG. 3 is a partial elevational view of a customer station provided with a reslurry jet.

In order to withdraw slurry product having, for example, a solids concentration in the range of 60–80 percent, from storage vessel 65, a portion of the slurry product is withdrawn therefrom through conduit 67 and is supplied to pump 69. The major portion of the withdrawn slurry product is recycled to vessel 65 under increased pressure through conduit 68. It has been found that by disposing the extremity of conduit 68 within vessel 65 as illustrated in FIG. 3, a relatively high degree of turbulence and fluidization is imparted to the settled solid carbon dioxide in the upper reaches of conduit 67 and in the lower reaches of vessel 65. By effectively dividing the flow of recycled slurry material by disposition of conduit 68 as illustrated in FIG. 3, a pumpable slurry product is formed and maintained both in conduit 67 and in the immediate vicinity thereof within vessel 65. Preferably, the extremity of conduit 68 from which slurry is emitted is oriented tangentially with respect to the entrance of conduit 67, thereby imparting a swirling motion to recycled slurry and the agitated contents of vessel 65. In addition, it will be appreciated that in order to avoid an excessive solids concentration from initially entering pump 69, and thereby jamming the same, suitable baffle devices (not shown) may be provided in general proximity to the discharge end of conduit 68 and the inlet of conduit 67.

The utilization devices provided at a typical customer station in accordance with the present invention may, for example, comprise a slurry dispenser 71, gas separator 72, and pelletizer 74. Slurry dispenser 71 is provided in communication with conduit 70 to receive slurry product at an inlet thereof and to deliver a metered quantity of carbon dioxide solid and vapor at an outlet thereof. Typically, slurry product is supplied to dispenser 71 at a pressure of, for example, 100–190 p.s.i.g. and is dispensed therefrom at atmospheric pressure in both gas and solid phases. An exemplary slurry dispenser which is suitable for the aforementioned purposes, is described in detail in application Ser. No. 294,734, filed Oct. 3, 1972, the disclosure of which is incorporated herein by reference. This dispenser may be modified by splitting the feed thereto such that each isolated chamber traverses less than 180°of a complete cycle of each gear path.

Gas separator 72 which may, for example, comprise conventional apparatus for separating gaseous and solid phases of a material is adapted to receive both such phases of carbon dioxide supplied thereto by slurry dispenser 71. Carbon dioxide gas may be conveniently vented to the atmosphere through conduit 73 and solid carbon dioxide particles may be supplied at the outlet of gas separator 72. It will be realized that any suitable apparatus for separating gaseous and solid carbon dioxide may be utilized as gas separator 72.

Pelletizer 74 which may, for example, take the form of a conventional apparatus capable of receiving solid carbon dioxide particles and forming carbon dioxide pellets therefrom is suitably arranged to receive carbon dioxide particles supplied at the outlet of gas separator 72. Examplary of apparatus which may be utilized as pelletizer 74 is a $CO_2$ pelletizer commercially available from Airco, Inc. under Model No. F-1000.

It is appreciated, therefore, that the aforementioned utilization devices 71, 72 and 74 are effective to provide an end carbon dioxide product in a form suitable for use by a particular customer or user thereof. However, should it be desired to provide carbon dioxide in a form other than pellets, pelletizer 74, for example, may be rendered unnecessary. For example, it may be desired to ultimately supply gaseous carbon dioxide which may be accomplished by effecting a melting of solid carbon dioxide particles in the slurry product in storage vessel 65 and vaporizing the resultant liquid.

The foregoing and other various changes in form and details may be made without departing from the spirit and scope of the invention. Consequently, it is intended that the appended claims be interpreted as including all such changes and modifications.

What is claimed is:

1. A system for transporting a solid-liquid carbon dioxide slurry including a vessel for retaining said slurry which during transport separates into solid carbon dioxide collected at the bottom of the vessel and a layer of liquid carbon dioxide thereabove, and vessel having a header disposed therein and a discharge pump having an outlet coupled to a slurry discharge conduit, the improvement comprising:

said discharge pump having a first inlet selectively coupled to said liquid carbon dioxide;

said header being substantially linear and having an inlet, a plurality of nozzles extending from said header along the length thereof and first and second end nozzles disposed in communication with either end of said header;

means for selectively coupling the outlet of said discharge pump to the inlet of said header;

a reslurry pump having an inlet selectively coupled to the bottom of said vessel and an outlet selectively coupled to said header inlet, said discharge pump having a second inlet selectively connected to the bottom of said vessel with said first end nozzle of said header juxtaposed with the inlet of said reslurry pump and said second end nozzle of said header juxtaposed with the second inlet of said discharge pump such that upon said discharge pump passing liquid $CO_2$ from the first inlet thereof to said header inlet, jets of liquid carbon dioxide emitted through said first and second header nozzles are effective to fluidize solid $CO_2$ collected in the inlet of said reslurry pump and in said second inlet of said discharge pump such that reslurried liquid-solid $CO_2$ is passed through said reslurry pump and said header nozzles into said vessel with the solid $CO_2$ collected at the bottom of said vessel thereby reslurried prior to removal of said slurry from said vessel through said discharge pump and said slurry discharge conduit.

* * * * *